US008080300B2

(12) United States Patent
Glenna et al.

(10) Patent No.: US 8,080,300 B2
(45) Date of Patent: Dec. 20, 2011

(54) TAPE ROLL TAB APPLICATION METHOD AND ARTICLE

(75) Inventors: Christopher M. Glenna, Dassel, MN (US); Paul J. Richtman, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1707 days.

(21) Appl. No.: 10/664,429

(22) Filed: Sep. 16, 2003

(65) Prior Publication Data

US 2004/0053045 A1 Mar. 18, 2004

Related U.S. Application Data

(62) Division of application No. 09/102,924, filed on Jun. 23, 1998, now Pat. No. 6,632,311.

(51) Int. Cl.
*B32B 9/00* (2006.01)
*B32B 33/00* (2006.01)
*B32B 17/12* (2006.01)

(52) U.S. Cl. ..... 428/40.1; 428/41.9; 428/192; 428/194; 428/373; 428/906; 206/389; 206/411

(58) Field of Classification Search ..... 428/40.1, 428/41.9, 194, 192, 906, 343; 206/53, 389, 206/411

See application file for complete search history.

(56) References Cited

U.S. PATENT DOCUMENTS 2,015,268 A * 9/1935 Hammond ..... 206/411
2,329,527 A 9/1943 Golub
3,247,956 A * 4/1966 Rosen ..... 225/90
3,920,016 A 11/1975 Mesek et al.
3,939,034 A 2/1976 Tanaka et al.
3,967,624 A 7/1976 Milnamow
4,512,462 A 4/1985 Dills
4,685,392 A 8/1987 Watanabe (Continued)

FOREIGN PATENT DOCUMENTS

EP 895953 2/1999

(Continued)

*Primary Examiner* — Patricia Nordmeyer
(74) *Attorney, Agent, or Firm* — Lisa P. Fulton

(57) ABSTRACT

A method of making a roll of adhesive tape that comprises providing a length of tape having a leading end, a trailing end, a first side, and a second side opposite the first side, wherein the second side of the tape is at least partially covered with pressure sensitive adhesive and providing a tab having first and second opposite ends having a length between them, a first side, and a second side, wherein at least a portion of the second side of the tab is covered with pressure sensitive adhesive. The method further comprises advancing the length of tape along a tape path, positioning the leading tape end about a central tape roll axis, and circumferentially winding the length of tape about the axis until a penultimate tape layer having a circumference is wound. The adhesive-covered portion of the second side of the tab is applied to the first side of the tape so that the first end of the tab is spaced from the trailing end of the tape length by a predetermined distance that is at least as long as the circumference of the penultimate layer of the tape roll and no longer than a total distance of the circumference of the penultimate layer and the length of the tab. The final layer of the tape length is circumferentially wound around the penultimate tape layer so that the trailing end of the tape overlays the tab between the first and second ends of the tab.

14 Claims, 4 Drawing Sheets

U.S. PATENT DOCUMENTS

| | | | | |
|---|---|---|---|---|
| 4,828,646 | A | 5/1989 | Chung | |
| 4,944,720 | A | 7/1990 | Suhr | |
| 4,978,330 | A | 12/1990 | Suhr | |
| 5,212,002 | A | 5/1993 | Madrzak | |
| 5,340,629 | A | 8/1994 | Rodighiero | |
| 5,620,544 | A | 4/1997 | Cram et al. | |
| 6,663,932 | B2 * | 12/2003 | McLaughlin et al. | 428/40.1 |

FOREIGN PATENT DOCUMENTS

| | | |
|---|---|---|
| JP | 7-78203 | 5/1984 |
| JP | 60-144268 | 7/1985 |
| JP | 60-245682 | 12/1985 |
| JP | 5-319405 | 12/1993 |
| WO | WO 93/14013 | 7/1993 |
| WO | WO 96/40578 | 12/1996 |

* cited by examiner

TAPE ROLL TAB APPLICATION METHOD AND ARTICLE

CROSS REFERENCE TO RELATED APPLICATIONS

This application is a divisional of U.S. application Ser. No. 09/102,924, filed Jun. 23, 1998, now U.S. Pat. No. 6,632,311 titled "Tape Roll Tab Application and Method and Article," by inventors Christopher M. Glenna and Paul J. Richtman. The priority application is incorporated by reference in its entirety herein.

TECHNICAL FIELD

The present invention relates to adhesive tape and more particularly to a tab for marking the start of a roll of adhesive tape and for facilitating the initial removal of tape from the roll.

BACKGROUND OF THE INVENTION

It is common for adhesive tape to be supplied in the form of individual rolls of material from which a user can remove desired tape lengths. These individual rolls of adhesive tape may be manufactured by any number of known methods. One typical method includes unwinding a large, wide supply roll of adhesive tape material, which is subsequently slit in the longitudinal direction and wound circumferentially into individual finished product rolls. More specifically, each length of tape, starting at a leading end, is typically wound on itself to adhere each wrap of tape to an adjacent, underlying wrap of tape until a desired length of tape is wound around the roll. The tape is then severed from the supply roll to define a trailing end of the tape and to complete the individual product roll.

In some cases, the end of the last wrap of tape is adhered directly to the underlying wrap, which may make it difficult for a user to locate and grasp the tape to begin unwinding the tape from the roll. To remove the tape from such a roll, the user must first locate the trailing end of the tape by closely inspecting the roll, which can be particularly difficult when the tape is transparent or when the tape is thin. The user will then often attempt to separate the tape from the underlying roll to which it is adhered by inserting a sharp object under the trailing end of the tape, such as scissors or a fingernail. Preferably, the user will be able to separate the tape from the underlying roll across the entire width of the tape. However, if the user cuts or damages the trailing end of the tape, a portion of the tape on one side of the cut may remain adhered to the roll while the user is pulling the portion on the other side of the cut away from the roll. When this happens, the tape may split or tear diagonally across the width of the tape, thereby leaving a slivered or torn portion of the tape adhered to the roll. The user must then again attempt to grasp the slivered end portion of the tape to remove the tape from the roll, which can be time consuming and frustrating. In some cases, the user may also cause undesirable damage to several underlying tape layers when using a sharp object to separate the tape from the roll. When this happens, the user may encounter problems with the tape tearing or breaking as each subsequent wrap of tape is unwound from the roll.

In order to provide an easier way for users to find the trailing end of the tape roll to begin removing tape from the roll, it is known to cover or deaden a portion of the tape during the manufacturing process by placing a piece non-adhesive material often referred to as a "tab" on the adhesive side of the tape near the trailing end of the tape roll. To properly position a tab relative to the end of the tape, the tab is typically placed on the length of tape after it is unwound from a supply roll and before it is subsequently wound onto a finished product roll. The length of tape is then cut at a predetermined position relative to the tab. In some situations, it is desirable to cut the tape to provide an "overtab" portion, where a portion of the tape adjacent to the trailing tape end extends beyond the tab, as shown in FIG. 1. As illustrated, a tab 10 is positioned at a distance X from the trailing end of the tape so that the end or overtabbed portion can adhere to the underlying roll, while the portion having the tab 10 is positioned adjacent to the roll without adhering to the roll. It is often preferable that the length of the overtabbed portion is long enough to keep the trailing end of the tape adhered to the roll to prevent the roll from becoming tangled with other tape rolls during processing, but short enough that the user only needs to remove a small portion of tape from the roll before the tab can be grasped.

It can be difficult, however, to accurately position the tab on each finished product roll during the manufacturing process. Inaccurate cutting of the tape and/or inaccurate placement of the tab relative to the trailing end of the tape roll can cause problems in the finished product rolls. For example, when the tape is cut so that the overtabbed portion is longer than desired, a large length of tape adjacent to the trailing tape end is exposed to and adheres to the underlying roll, thereby diminishing or eliminating the usefulness of a tab. For another example, the tape may be cut so that the overtabbed portion is shorter than desired. In this case, the small overtabbed portion may not provide enough exposed adhesive to keep the trailing end of the tape adhered to the roll. This is particularly true when the tab material is stiffer than the tape and therefore does not easily conform to the curve of the tape roll unless it is sufficiently adhered to the roll surface. In these cases, the trailing end of the tape is free from the roll, including the tab and a small area of exposed adhesive. This exposed adhesive can cause manufacturing and processing problems when the adhesive sticks to other tape rolls or manufacturing equipment.

Another problem may also be created in the manufacturing process when the tape is cut within the portion that contains the tab, thereby cutting the tab into two portions. The first portion of the tab will then extend from the tape roll to the trailing end of the tape and leave no overtabbed portion on the product roll to keep the end of the tape adhered to the roll. Thus, the trailing end of the tape is free from the roll. In addition, the second portion of the tab remains on the end of the supply roll, which is often subsequently used at the beginning of the next roll of finished product. This second tab portion may then become the start or leading end of the next product roll, which may cause an undesirable bulge in the tape roll in the area of the tab as subsequent wraps of tape are wound over this tab piece 10, as shown in FIG. 2.

In some situations, it may not be desirable to provide an overtabbed portion on a tape roll. Rather, it may be preferable for the trailing end of the tape to be free from the underlying roll so that the user can easily locate and grasp an adhesive free tape end to unwrap the tape from the roll. However, the same manufacturing issues encountered when trying to accurately place a tab relative to the end of an overtabbed roll are also a concern when trying to position a tab relative to the trailing tape end so that the end portion is free from the roll. In other words, it is also difficult to accurately position the tab on each finished product roll so that it extends only to the end of the tape roll without leaving an overtabbed portion of adhesive tape at the end of the supply roll.

SUMMARY OF THE INVENTION

In one aspect of this invention, a method of making a roll of adhesive tape is provided, wherein the method comprises the steps of providing a length of tape having a leading end, a trailing end, a first side, and a second side opposite the first side, wherein the second side of the tape is at least partially covered with pressure sensitive adhesive and providing a tab having first and second opposite ends, a length between the first and second ends, a first side, and a second side, wherein at least a portion of the second side of the tab is covered with pressure sensitive adhesive. The method further comprises advancing the length of tape along a tape path, positioning the leading tape end about a central tape roll axis, and circumferentially winding the length of tape about the axis until a next to last, or penultimate tape layer is wound, wherein the penultimate tape layer has a circumference. The adhesive-covered portion of the second side of the tab is applied to the first side of the tape so that the second end of the tab is spaced from the trailing end of the tape length by a predetermined distance, wherein the predetermined distance is at least as long as the circumference of the penultimate layer of the tape roll and no longer than a total distance of the circumference of the penultimate layer and the length of the tab. The final layer of the tape length is circumferentially wound around the penultimate tape layer so that the trailing end of the tape overlays the tab between the first and second ends of the tab.

Also provided is a tape roll comprising a central tape roll axis, a length of tape having a leading end, a trailing end opposite the leading end, a first side, and a second side opposite the first side, wherein the second side of the tape is at least partially covered with pressure sensitive adhesive, and wherein the tape is circumferentially wound about the axis until a plurality of adjacent tape layers are wound, and a tab having first and second opposite ends, a first side, and a second side opposite the first side, wherein at least a portion of the second side of the tab is covered with pressure sensitive adhesive. In accordance with the invention the adhesive portion of the second side of the tab is adhered to the first side of the tape on a penultimate tape layer of the roll so that the trailing end of the tape overlays the tab between the first and second ends of the tab.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
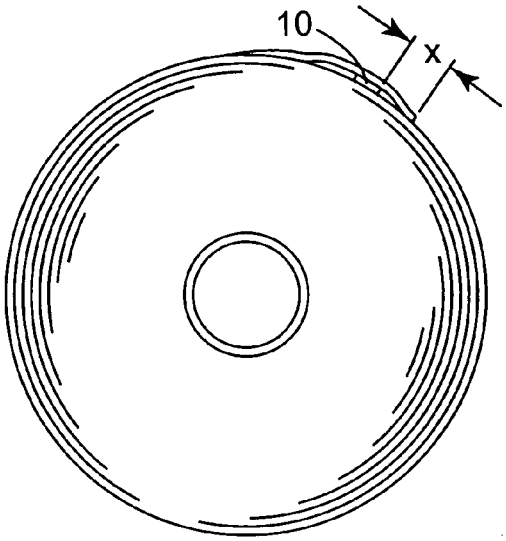
Fig. 1 PRIOR ART
FIG. 1 is a perspective view of a prior art tape roll having a tab spaced from the end of the tape material.
Figure 2:
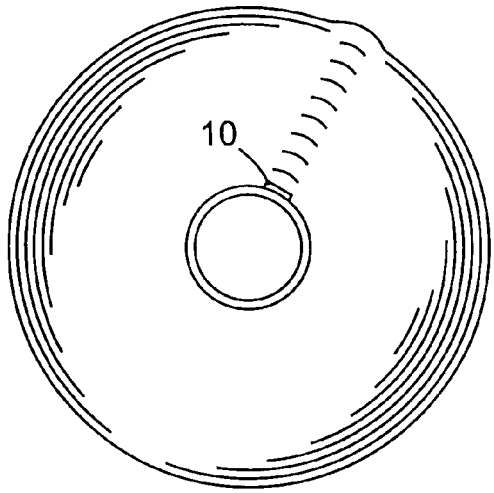
Fig. 2 PRIOR ART
FIG. 2 is a perspective view of a prior art tape roll having a portion of a tab positioned near the central area of the tape roll.
Figure 3:
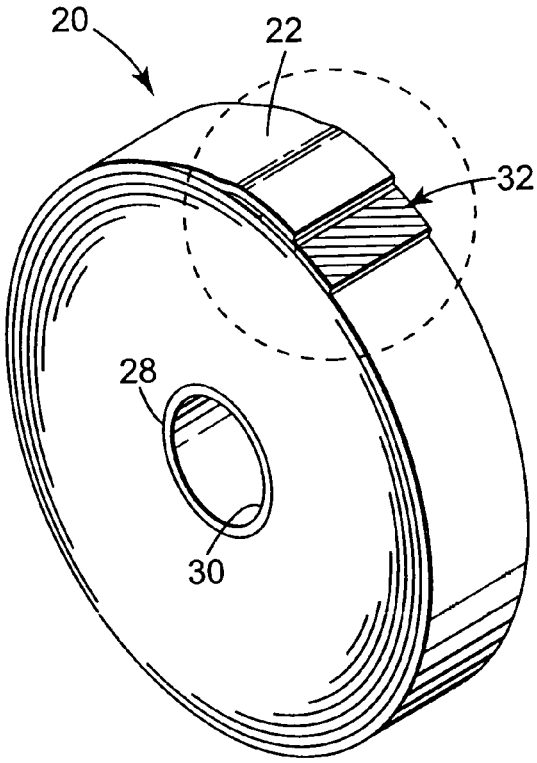
FIG. 3 is a perspective view of an adhesive tape roll having one preferred tab embodiment in accordance with the present invention.
Figure 3A:
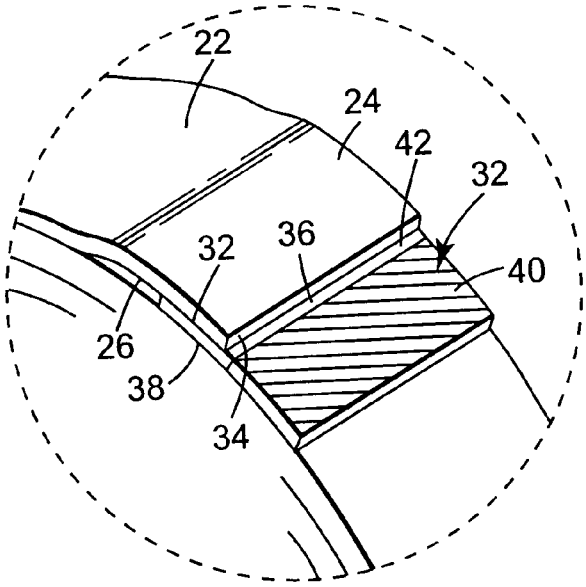
FIG. 3*a* is an enlarged perspective view of the encircled portion of FIG. 3, showing the tab arrangement in more detail.

Referring now to the Figures, wherein the components are labeled with like numerals throughout the several Figures, and initially to FIGS. 3 and 3*a* where FIG. 3*a* is an enlarged view of the encircled portion of FIG. 3, a roll of adhesive tape 20 is illustrated. The tape roll 20 comprises an elongated, flexible strip of tape material 22 having a first side 24 and a second side 26. The strip 22 is wound circumferentially onto the outside surface 28 of a core 30 which supports the roll 20. The adhesive tape of the present invention is of the type that preferably comprises a backing layer having adhesive coated onto one side of the tape material. In the embodiment of FIGS. 3 and 3*a*, the adhesive is coated onto the second side 26 of the tape material 22.

It is preferred that the backing layer is a film. A non-exclusive list of conventional polymeric backing layer films follows with the understanding that any could be suitable for use as a tape backing layer: cellulose acetate, polyethylene, polypropylene, polyester (such as polyethylene terepthalate (PET)), biaxially oriented polypropylene (BOPP), polyvinyl chloride (PVC), copolymers of propylene and ethylene, and copolymers of ethylene and olefins having four or more carbon atoms, or blends of any of the above. However, it is also contemplated that the backing layer may be paper, woven materials, non-woven materials, or other known materials suitable for an adhesive tape backing layer.

Although it is preferable that the second side 26 of the tape material 22 is coated with adhesive across its entire width and length, it is understood that the adhesive may extend only across a portion of the tape width and/or along only a portion of the tape length. Some suitable adhesives for use in the adhesive tape of the present invention are generally based on compositions of polyacrylate; polyvinyl ether; diene-containing rubber such as natural rubber, polyisoprene, and polybutadiene; styrene-butadiene rubber; polychloroprene; butyl rubber; butadiene-acrylonitrile polymer; thermoplastic elastomer block copolymers such as styrene-isoprene (SI) and styrene-isoprene-styrene (SIS) block copolymers, styrene-butadiene (SB) and styrene-butadiene-styrene polymers (SBS), and ethylene/propylene and ethylene-butylene-diene polymers such as styrene-ethylene/propylene-styrene (SEPS) and styrene-ethylene/butylene-styrene (SEBS); poly-alpha-olefin; amorphous polyolefin; silicone; ethylene-containing copolymer such as ethylene vinyl acetate, ethyl ethyl acrylate, and ethyl methacrylate; polyurethane; polyamide; epoxy; polyvinylpyrrolidone and vinylpyrrolidone copolymers; polyesters; and mixtures of the above. The use of some of these compositions to give specific characteristics to the adhesives may require cross-linking or curing by methods well known in the art. Additionally, the adhesives can contain additives such as tackifiers, plasticizers, antioxidants, stabilizers, curatives, and solvents.

In addition, a low adhesion backsize is preferably provided on the first side 24 of the tape material 22 so that the tape can be unwound more easily from the tape roll 20. In order to increase the anchorage of the low adhesion backsize or adhesive to the backing layer, it may also be desirable to treat one or both surfaces of the tape material 22 before coating the surface with the low adhesion backsize or adhesive. This may be done either by coating a layer of primer material on the backing layer, by surface treating the backing layer with corona treatments, flame treatments, or the like, or by both surface treating and coating a primer onto the backing layer. Such coatings and/or treatments are well known, and any can be used in accordance with the present invention if they are otherwise suitable for use in the desired tape construction.

The tape roll 20 is further provided with a tab 32 positioned near an end 34 of the strip of material 22. The end 34 may be referred to as the "trailing end" because it is the last part of the tape material to be wrapped onto the roll during manufacturing. The tab 32 will be used to facilitate the initial unwinding of the tape material 22 from the roll 20. In one preferred embodiment, tab 32 of the present invention comprises a first side 36 and a second side 38 opposite the first side 36. The second side 38 of the tab 32 includes a first or non-adhesive portion 40, which provides the portion that may be visually located and grasped by the user to begin pulling tape from the roll. The second side 38 further comprises a second portion 42 having exposed adhesive. The non-adhesive portion 40 of the tab 32 is shown as the dark, shaded portion of the tab throughout the several Figures for clarity in identifying the non-adhesive portion, although it is not necessary that the portion 40 be visually distinct from the portion 42. The adhesive on the second portion 42 may be the same or a different adhesive, having the same or a different adhesive strength and adhesive characteristics, from the adhesive that is coated on the second side 26 of the tape material 22. The adhesives described above as suitable for the second side 26 of the tape material 22 are similarly appropriate for the adhesive portion 42 of the tab 32. However, this list of adhesives is not meant to be exclusive and other known adhesives may also be appropriate for use on tab 32.

While the first and second portions 40, 42 are illustrated as having approximately equal areas, the first portion 40 may be substantially smaller or larger than the second portion 42, depending on the desired use of the tape roll.

Many different tab constructions are contemplated and considered to be within the scope of the present invention, where several examples are explained below. One possible tab construction, illustrated in FIGS. 3 and 3*a*, includes using a non-adhesive backing layer that may be paper, film, or other known material suitable for use as a tab. Adhesive may then be coated on the second portion 42 of the second side 38, while leaving the first portion 40 of the second side 38 without adhesive.

Another alternative construction of the tab 32 includes coating one side of a backing layer of the tab with adhesive along at least a portion of its length and width, then subsequently coating a portion of the adhesive with a deadening layer to substantially decrease or "deaden" the adhesive strength in that portion of the tab. The deadening layer may be, for example, an ink or other printing material that is coated onto the adhesive.

In another alternative embodiment (shown in FIG. 4), a second side 138 of a tab 132 is coated with adhesive along its length and width, then a portion of one end of the tab 132 is folded toward the second or adhesive-coated side 138 of the tab until the folded portion is adhered to the second side 138 of the tab 132, thereby providing a portion of the tab without exposed adhesive (i.e., a tab portion 140).

Figure 4:
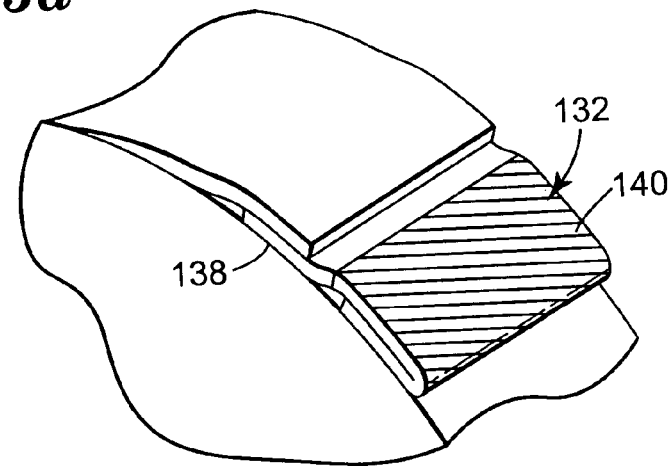
FIG. 4 is a perspective view of a portion of a tape roll similar to that of FIG. 3*a*, having an alternate tab embodiment.
Figure 5:
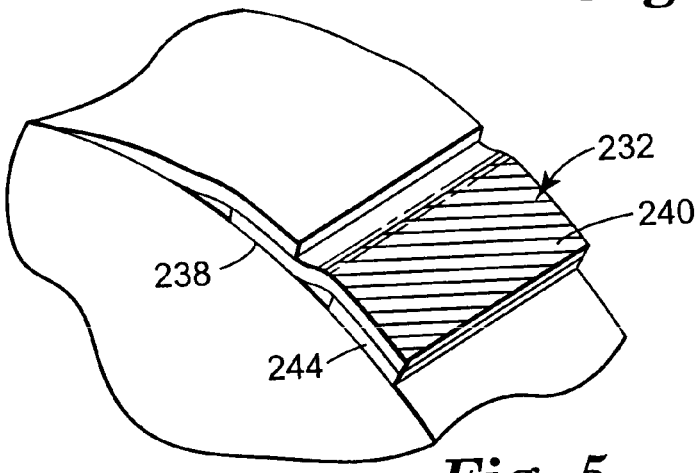
FIG. 5 is a perspective view of a portion of a tape roll similar to that of FIG. 3*a*, having another alternate tab embodiment.

FIG. 5 illustrates another alternative tab of the present invention in a view similar to that shown in FIG. 4. In this embodiment, the method of providing a tab 232 having adhesive and non-adhesive portions includes coating a second side 238 of the tab 232 with adhesive along at least part of its length and width, then laminating a strip of non-adhesive material 244, such as film or paper, to a portion of the adhesive-coated side 238 of the tab 232. The area of tab 232 having the non-adhesive material 244 laminated thereto is a non-adhesive portion 240, such as that described above. Other known methods of providing a non-adhesive portion adjacent an adhesive portion on a piece of material that may be used on a tab are also considered to be within the scope of the invention, such as laminating a strip of material having adhesive on one side to a strip of tab material that may have adhesive coated onto all or part of one of its sides, for example.

One preferred method of applying tab 32 to the tape roll 20 in accordance with the present invention will now be described with reference to FIGS. 3, 3*a*,6, and 7, which illustrate a tape roll 20 of the present invention with a length of tape material 22 that is provided from a tape source (not shown) and wound around core 30. As is typical, the tape roll 20 is wound so that the second or adhesive side 26 of the tape material is facing toward the center of the roll 20 and the first or non-adhesive side 24 is facing away from the center of the roll. The tape source that provides the lengths of tape material 22 may be a supply roll of tape material that is often substantially longer and/or wider than the finished product rolls, and has enough tape material to make multiple smaller tape rolls 20. Alternatively, the tape material 22 may be provided directly from a tape manufacturing operation so that no intermediate supply roll of tape material is necessary. In any case, the tape material 22 is wound about core 30 and successively upon itself until the next to last, or penultimate, tape layer is wound.

Figure 6:
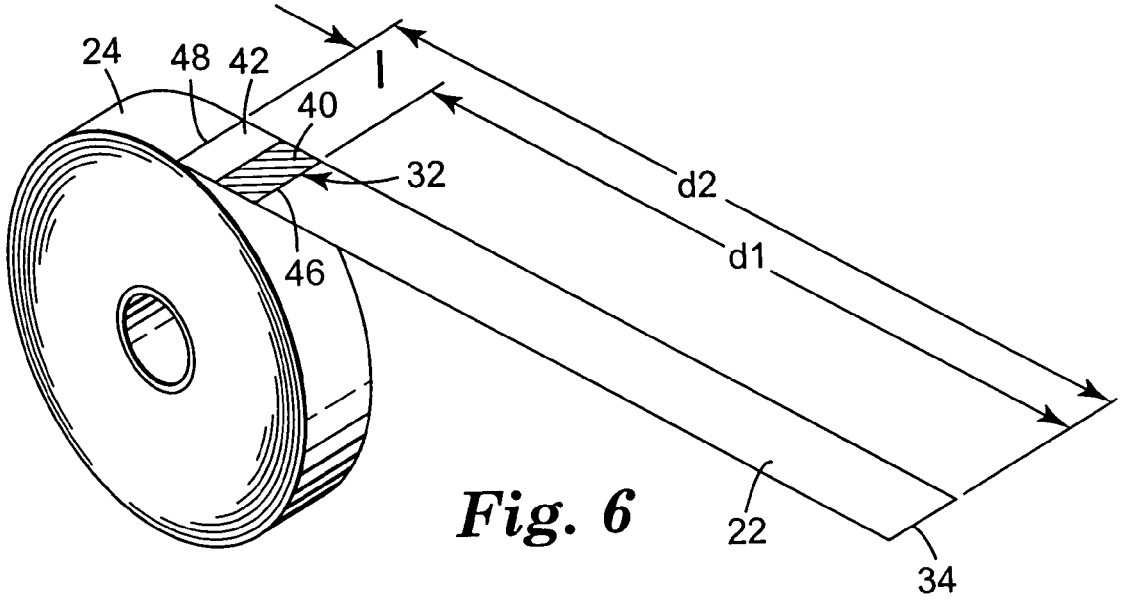
FIG. 6 is a perspective view of the tape roll of FIG. 3, showing a length of tape extending from the roll.

In accordance with the present invention, before the entire length of tape is wound onto the roll, a tab 32 is applied to the first or non-adhesive side 24 of the tape material 22 at a particular distance from end 34 of the roll, as shown in FIG. 6. More specifically, the tab 32 is positioned so that a first end 46 of the tab 32 is at a distance $d_1$ from end 34 of the roll, and a second end 48 of the tab 32 is at a distance $d_2$ from the end 34 of the tape roll, where the first end 46 is adjacent to the non-adhesive tab portion 40 and the second end 48 is adjacent to the adhesive tab portion 42. The length of the tab 32 is designated as "e" and is equal to the distance between its first and second ends 46, 48. The tab 32 may be applied to the first side 24 of the tape material 22 at any point before the entire length of tape is wound onto the roll. For one example, the tab 32 may be applied immediately before the end 34 of the roll (and tape material 22 adjacent thereto) begins to overlap the tab 32. For another example, the tab 32 may be applied at a further distance from the tape roll 20 and closer to the supply roll of tape, as long as the tab 32 is in the proper position when the penultimate layer is wound and the end 34 of the roll is reached.

In the preferred embodiment, the tab 32 is positioned on the tape length 22 so that the distance $d_1$ is approximately equal to the circumference of the tape roll before the final tape portion having the tab adhered thereto is wound around the roll. More preferably, the tab 32 will be positioned so that the distance $d_1$ is slightly smaller than the circumference of the tape roll. However, the distance $d_1$ may be considerably smaller than the circumference of the tape roll, as long as the length distance $d_1$ is larger than the difference between the circumference of the tape roll and the length l of the tab 32. In addition, the tab is preferably positioned so that the distance $d_2$ is larger than the circumference of the tape roll.

Figure 7:
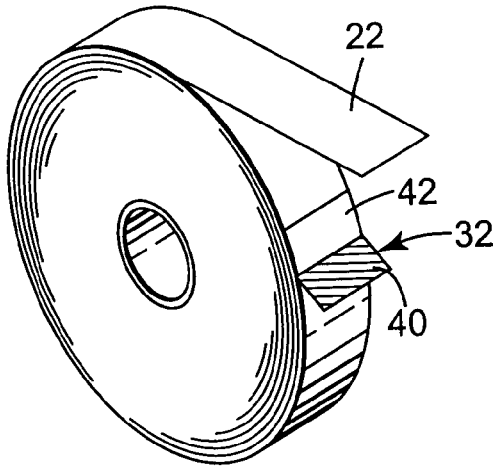
FIG. 7 is a perspective view of the tape of FIG. 6, with only a small portion of the tape length extending from the roll.

After the tab 32 is applied, the remaining length of the tape material 22 is wrapped around the tape roll 20, as shown in FIG. 7. Because the distance $d_1$ is selected to be approximately equal to or slightly smaller than the circumference of the roll, when the end 34 of the tape material 22 is wound around the roll, as shown in FIGS. 3 and 3*a*, the end 34 will fall on top of the tab 32 between the tab ends 46, 48. Preferably, the-tape material 22 adjacent to the end 34 will overlay both the adhesive and non-adhesive portions 40, 42 of the tab 32. However, only a sufficient portion of the material 22 must overlay the tab 32 to allow the user to pull the tab away from the roll to begin removal of tape from the roll. In this way, the non-adhesive portion 40 of the tab 32 will be free from the tape roll 20, thereby providing an adhesive-free tab portion for a user to grasp to pull the tape material 22 from the tape roll 20.

Figure 8:
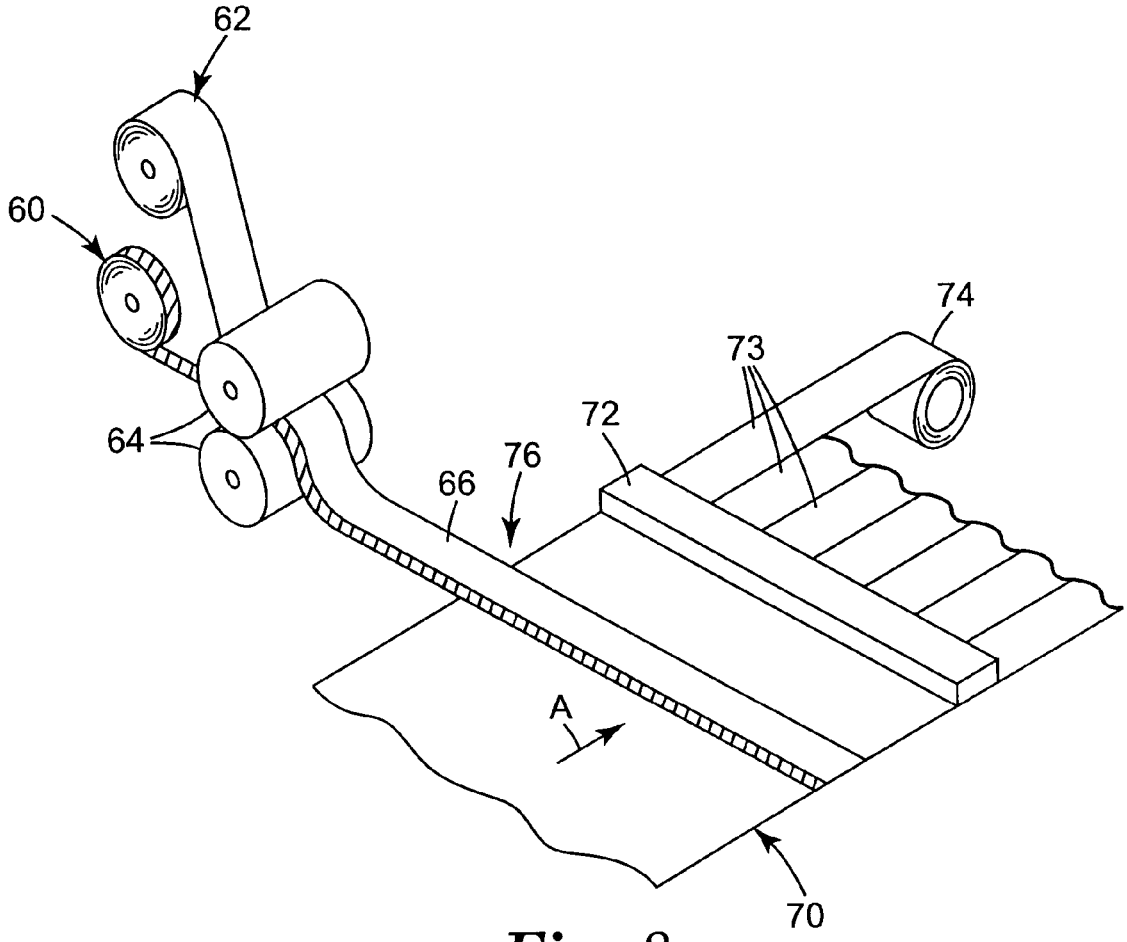
FIG. 8 is a schematic view of one method of applying a tab to multiple rolls of tape during a converting process.

The embodiments of the tab 32 described above may be manufactured remotely from the tape roll manufacturing and converting processes of the present invention and provided to these processes as a pre-manufactured roll of tab material. However, a schematic view of an alternative procedure is illustrated in FIG. 8, where the tab construction of FIG. 5 is made immediately before the tab material is applied to the tape to make multiple finished product rolls of tape. More specifically, a roll of non-adhesive web material 60, such as any suitable deadening material described above, and a roll of adhesive tape material 62, such as a conventional transparent tape, are preferably rotatably supported for dispensing their respective materials. In the preferred embodiment, web material 60 is more narrow than adhesive tape material 62, where the width of web material 60 is preferably between 25 percent and 50 percent of the width of tape material 62 and more preferably between 35 percent and 45 percent of the width of tape material 62. However, the web material 60 may instead be less than 25 percent or greater than 50 percent of the width of tape material 62.

The web material 60 and tape material 62 are then guided by conventional guiding means toward a pair of laminating rolls 64, where the web material 60 is laminated along one edge of the tape material 62 to form one web of composite tab material 66. The web material 60 may be positioned relative to the tape material 62 so that a portion of the web material 60 extends beyond the edge of the tape material 62. Alternatively, the edge of the web material 60 and the edge of the tape material 62 may be aligned with each other, or a portion of the tape material 62 may extend beyond one edge of the web material 60. After lamination, the composite tab material 66 is directed through conventional guiding means toward a manufacturing process to apply the tab material to adhesive tape material in accordance with the present invention.

With continued reference to FIG. 8, one preferred method of applying tab material to tape rolls is illustrated. While this Figure illustrates the application of the composite tab material 66 described above, it is understood that the tab material may instead be made by some other method immediately prior to application to tape material, or may be provided to the operation as a pre-manufactured roll of tab material. However, in this method, an adhesive tape web 70 is unwound from a supply roll (not shown) and guided by conventional guiding means toward a slitting apparatus 72, where the adhesive tape web 70 is slit in the longitudinal direction into individual tape strips 73. Each tape strip 73 is then wound into product rolls 74 (only one of which is shown), with the adhesive side of the tape strip facing the inside of the roll. Typically, a predetermined length of tape is to be wound into each product roll 74. Thus, a known measuring device or apparatus (not shown) is used to measure or calculate the length of tape being wound onto each roll and to thereby determine when the predetermined length of tape is reached.

Before the predetermined tape length is reached, composite tab material 66 is applied laterally across the width of the web 70 at a station generally shown as tab application station 76, where the web may be moving in, the direction of the arrow 'A' or may be stopped temporarily. This composite tab material 66 is applied at a location that will position tabs properly relative to the end of each tape roll in accordance with the present invention, as described above. The portion of web 70 with the strip of composite tab material 66 adhered thereto then advances through the slitting apparatus 72, where the tab material 66 and web 70 are simultaneously longitudinally slit to the same width as each tape strip 73. Each tape strip 73 continues to be wound around its respective product roll 74 until the portion of the tape strip 73 having the tab material 66 laminated thereto is wound onto the roll 74. Each tape strip 73 is cut from the supply in the lateral direction at the location that will allow the end of the tape to be positioned as described above relative to the tab. However, it is also contemplated that the web be cut laterally before the slitting apparatus 72.

The process of FIG. 8 is typically repeated multiple times, where the supply roll of adhesive tape provides tape for additional product rolls that are subsequently produced after the first set of product rolls are completed. However, it is understood that the tabs of the present invention can also be applied to tape rolls by many other methods, such as by manual application or by applying pre-cut tabs to each product roll before the final wrap of tape is wound into the roll, for example.

It is further contemplated that the second side 38 of the tab shown in FIG. 3*a* may be completely coated with adhesive, including the first portion 40. However, in order to avoid the inconveniences described above with regard to locating the trailing end of a tape roll, the adhesive preferably has a relatively low adhesive strength. More specifically, tab 32 includes first or non-adhesive side 36 and second side 38 that is coated across its entire length and width with an adhesive that preferably has a lower adhesive strength than the adhesive provided on the second side 26 of tape roll 20. One example of this adhesive is a repositionable pressure sensitive adhesive such as that described in U.S. Pat. Nos. 4,166,152, 3,857,731, and 3,691,140, commonly owned by the Minnesota Mining and Manufacturing Company of St. Paul, Minn., the entire contents of which are incorporated herein by reference. This tab is applied to the tape material 22 in a similar method to that described above. Thus, adhesive-coated side 38 of the tab is applied to the non-adhesive side 24 of the tape material before the final wrap of tape material is wound circumferentially around the tape roll, where its first edge is at distance $d_1$ from the tape end 34. After the tab 32 is applied, the remaining length of the tape material 22 is wrapped around the tape roll until the end of the tape material is reached and the end of the tape material overlays at least a portion of the tab. In this embodiment, the adhesive on the second side 38 of the tab will preferably adhere the tab to the surface of the tape roll, but preferably has a sufficiently low adhesive strength to allow the user to easily separate the end of the tab from the surface of the tape roll 20.

The tab on each finished tape roll of the present invention preferably has a width that is equal to the width of the strip of tape material to which it is adhered. It is understood, however, that the width of the tab may instead be wider or more narrow than the strip of material to which it is applied. Further, the tab may be generally transparent across its length and width. Alternatively, at least a portion of the tab may be opaque or translucent so that the tab is easier for a user to visually locate on the roll. For example, the non-adhesive portion of the tab may be colored or printed with a pattern that makes the end of the tape material more easily distinguishable from the roll itself.

Although the tape roll 20 typically has a core 30 in the center of the roll, as described above, it is understood that the tab and method of applying the tab of the present invention may also be used with rolls of tape that do not include a core. Rolls of tape of this type may be manufactured by any number of known methods that typically include winding a length of tape about a mandrel or shaft until the end of the tape is reached The roll of tape is then removed from the mandrel or shaft, thereby producing a roll of tape material that does not have a central core. The same tabs and methods for applying tabs to tape rolls described above with regard to a tape roll having a core are similarly applicable to coreless tape rolls.

An alternative method for manufacturing tape rolls may also be used in accordance with the present invention. In this method, a core is provided that has a width that is larger than that of the desired finished product rolls. Tape material from a supply roll is wound about this core and successively upon itself until the next to last, or penultimate, tape layer is wound. As described above, at some point before the final length of tape is wound onto the roll, tab material of the type described is applied to the non-adhesive side of the tape material at a particular distance from the end of the roll so that the tab material is positioned relative to the end of the roll in accordance with the present invention. After the final length of tape is wound onto the roll, the entire roll (including the core and the wound tape material) is cut, such as by lathe slitting, to produce rolls of the desired width.

The present invention has now been described with reference to several embodiments thereof The foregoing detailed description has been given for clarity of understanding only. No unnecessary limitations are to be understood therefrom. It will be apparent to those skilled in the art that many changes can be made in the embodiments described without departing from the scope of the invention. For instance, it is also contemplated to use the tab and method of applying a tab of the present invention with rolls of other types of material having adhesive on at least a portion of one of its sides, such as filament tape, masking tape, packaging tape, medical tapes, electrical tapes, double-coated linered tapes and double-coated tapes, including those double-coated tapes, that have a roll liner wrapped around the final layer of the tape roll to prevent contaminants or other material from adhering to the outermost layer. Thus, the scope of the present invention should not be limited to the structures described herein, but only by the structures described by the language of the claims and the equivalents of those structures.

What is claimed is:

1. A tape roll comprising:

a central tape roll axis;

a length of tape comprising a leading end, a trailing end opposite the leading end, a first side, and a second side opposite the first side, wherein the second side of the tape is at least partially covered with pressure sensitive adhesive, and wherein the tape is circumferentially wound about the axis until a plurality of adjacent tape layers are wound; and a tab having first and second opposite ends, a first side, and a second side opposite the first side, wherein at least a portion of the second side of the tab is covered with pressure sensitive adhesive;

wherein the adhesive portion of the second side of the tab is adhered to the first side of the tape on a penultimate layer of the roll so that the trailing end of the tape overlays the tab between the first and second ends of the tab; and wherein the second side of the tab comprises a non-adhesive portion having first and second ends, the first end of the non-adhesive portion coinciding with the first end of the tab; and the adhesive portion of the second side of the tab having first and second ends, the first end of the adhesive portion being located adjacent to the second end of the non-adhesive portion, and the second end of the adhesive portion coinciding with the second end of the tab.

2. The tape roll of claim 1, wherein the tab comprises a deadening layer to provide the non-adhesive portion of the tab.

3. The tape roll of claim 1, wherein the tab comprises at least a portion of the adhesive portion of the second side of the tab folded toward and adhered to the second side of the tab to provide the non-adhesive tab portion.

4. The tape roll of claim 1, wherein the tap comprises a web material laminated to at least a portion of the adhesive on the second side of the tab to provide the non-adhesive tab portion.

5. The tape roll of claim 1, wherein the trailing end of the tape overlays both the adhesive and non-adhesive portions of the tab.

6. The tape roll of claim 1, wherein the adhesive portion of the tab is spaced from the trailing end of the tape by a distance that is at least as long as a circumference of the penultimate layer of the roll and is no longer than a total distance of the circumference of the penultimate layer and a length of the tab.

7. The tape roll of claim 1, wherein the adhesive on the second side of the tab has the same adhesive strength as the adhesive on the second side of the length of tape.

8. The tape roll of claim 1, wherein the adhesive on the second side of the tab has greater adhesive strength than the adhesive on the second side of the length of tape.

9. The tape roll of claim 1, wherein the adhesive on the second side of the tab has less adhesive strength than the adhesive on the second side of the length of tape.

10. The tape roll of claim 1, wherein the adhesive on the second side of the tab is a repositionable pressure sensitive adhesive.

11. The tape roll of claim 1, further comprising a tape core defining the central tape roll axis, wherein the length of tape is circumferentially wound about the core.

12. The tape roll of claim 1, wherein the length of tape has a width, the tab has a width, and the width of the length of tape is approximately equal to the width of the tab.

13. The tape roll of claim 1, wherein the tab is generally transparent across its length and width.

14. The tape roll of claim 1, wherein at least a portion of the tab is opaque or translucent.

* * * * *

UNITED STATES PATENT AND TRADEMARK OFFICE

CERTIFICATE OF CORRECTION

PATENT NO. : 8,080,300 B2
APPLICATION NO. : 10/664429
DATED : December 20, 2011
INVENTOR(S) : Christopher Melvin Glenna It is certified that error appears in the above-identified patent and that said Letters Patent is hereby corrected as shown below:

Column 4
Line 26, delete “terepthalate” and insert -- terephthalate --, therefor.

Column 6
Line 12, delete “3a,6,” and insert -- 3a, 6, --, therefor.
Line 39, delete ““e”” and insert -- “ℓ” --, therefor.

Column 7
Line 2, delete “the-tape” and insert -- the tape --, therefor.

Line 67, delete “in,” and insert -- in --, therefor.

Column 9
Line 29, after “thereof” insert -- . --.

Column 10
Line 17, in Claim 2, after “tab” insert -- further --.

Line 20, in Claim 3, after “tab” insert -- further --.

Line 24, in Claim 4, delete “tap” and insert -- tab --, therefor.

Signed and Sealed this
First Day of May, 2012

David J. Kappos

David J. Kappos
*Director of the United States Patent and Trademark Office*